US006136776A

United States Patent [19]

Dickler et al.

[11] Patent Number: 6,136,776

[45] Date of Patent: Oct. 24, 2000

[54] GERMICIDAL DETERGENT PACKET

[75] Inventors: Lawrence R. Dickler, Cherry Hill, N.J.; J. Barry Ruck, Wynnewood, Pa.

[73] Assignee: Dickler Chemical Laboratories, Inc., Philadelphia, Pa.

[21] Appl. No.: 09/271,841

[22] Filed: Mar. 18, 1999

Related U.S. Application Data

[63] Continuation-in-part of application No. 08/834,681, Apr. 1, 1997, Pat. No. 6,037,319.

[51] Int. Cl.[7] ..... C11D 17/00; C11D 3/48; C11D 15/10

[52] U.S. Cl. ..... 510/439; 510/296; 510/337; 510/338; 510/384; 510/406; 510/409; 510/418; 510/504

[58] Field of Search ..... 510/384, 439, 510/441, 461, 406, 409, 418, 504, 296, 337, 338

[56] References Cited

U.S. PATENT DOCUMENTS

| | | | |
|---|---|---|---|
| 2,936,263 | 5/1960 | Hardt et al. | 167/55 |
| 3,113,674 | 12/1963 | Kiefer et al. | 206/84 |
| 3,186,869 | 6/1965 | Friedman . | |
| 3,277,009 | 10/1966 | Freifeld et al. . | |
| 3,322,674 | 5/1967 | Friedman . | |
| 3,528,921 | 9/1970 | Gray . | |
| 3,784,005 | 1/1974 | McVay . | |
| 3,790,067 | 2/1974 | Scheier . | |
| 3,859,125 | 1/1975 | Miller et al. . | |
| 3,870,647 | 3/1975 | Travers | 252/118 |
| 3,919,678 | 11/1975 | Penfold . | |
| 4,188,304 | 2/1980 | Clarke et al. . | |
| 4,285,841 | 8/1981 | Barrat et al. . | |
| 4,416,791 | 11/1983 | Haq . | |
| 4,507,219 | 3/1985 | Hughes | 252/118 |
| 4,622,161 | 11/1986 | Cornelissens et al. . | |
| 4,747,976 | 5/1988 | Yang et al. . | |
| 4,820,435 | 4/1989 | Zafiroglu . | |
| 4,846,992 | 7/1989 | Fonsny . | |
| 4,973,416 | 11/1990 | Kennedy . | |
| 5,015,513 | 5/1991 | Newbold et al. . | |
| 5,035,930 | 7/1991 | Lacourse et al. . | |
| 5,042,228 | 8/1991 | Pearson . | |
| 5,043,196 | 8/1991 | Lacourse et al. . | |
| 5,080,819 | 1/1992 | Morganson et al. . | |
| 5,132,036 | 7/1992 | Falou et al. . | |
| 5,158,810 | 10/1992 | Oishi et al. . | |
| 5,198,198 | 3/1993 | Gladfelter et al. | 422/264 |
| 5,234,615 | 8/1993 | Gladfelter et al. . | |
| 5,248,038 | 9/1993 | Hodakowski et al. . | |
| 5,253,759 | 10/1993 | Gouge et al. . | |
| 5,280,835 | 1/1994 | Edwards et al. . | |
| 5,294,361 | 3/1994 | Van den Brom . | |
| 5,310,568 | 5/1994 | Lini . | |
| 5,316,688 | 5/1994 | Gladfelter et al. . | |
| 5,316,689 | 5/1994 | Farrell . | |
| 5,328,025 | 7/1994 | Hodakowski et al. . | |
| 5,330,047 | 7/1994 | Gouge et al. . | |
| 5,351,831 | 10/1994 | Gouge et al. . | |
| 5,384,364 | 1/1995 | Besse et al. | 252/90 |
| 5,389,425 | 2/1995 | Platt et al. . | |
| 5,534,178 | 7/1996 | Bailly et al. | 510/367 |
| 5,780,418 | 7/1998 | Niinaka et al. | 510/439 |
| 5,783,541 | 7/1998 | Tack et al. | 510/224 |
| 5,798,329 | 8/1998 | Taylor et al. . | |

*Primary Examiner*—Yogendra Gupta
*Assistant Examiner*—John M. Petruncio
*Attorney, Agent, or Firm*—Caesar, Rivise, Bernstein, Cohen & Pokotilow, Ltd

[57] ABSTRACT

Water-soluble packets containing liquid germicidal detergent concentrates are provided. The germicidal detergent concentrate preferably includes about 55 wt. % to about 75 wt. % of at least one quaternary ammonium compound having the general structural formula I:

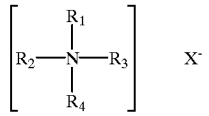

where each of $R_1$, $R_2$, $R_3$ and $R_4$ is independently a hydrophobic, aliphatic, aryl aliphatic or aliphatic aryl radical of from 6 to 26 carbon atoms, and X is an anion; about 15 wt. % to about 35 wt. % of at least one nonionic surfactant; and about 5 wt. % to about 15 wt. % of at least one polyol containing from 2 to 6 carbons and from 2 to 6 hydroxyl groups. Also provided are methods of cleaning and disinfecting, in which the packets are added to a volume of water to dissolve and form a cleaning solution, which is used to clean and disinfect a material.

23 Claims, No Drawings

GERMICIDAL DETERGENT PACKET

CROSS-REFERENCES TO RELATED APPLICATIONS

This application is a continuation-in-part of our prior patent application, U.S. patent application Ser. No. 08/834,681 filed Apr. 1, 1997, now U.S. Pat. No. 6,037,319.

FIELD OF THE INVENTION

This invention relates to liquid cleaning compositions packaged within water-soluble packets, and more particularly to a germicidal detergent packaged within a water-soluble packet.

BACKGROUND OF THE INVENTION

Liquid cleaning compositions are often considered to be more convenient to employ than dry powdered or particulate products and, therefore, have found substantial favor with consumers. They are readily measurable, speedily dissolved in water, capable of being easily applied in concentrated solutions or dispersions to soiled areas to be cleaned and are non-dusting, and they usually occupy less storage space. Furthermore, liquids are more environmentally sound since they eliminate the requirement for organic salts, including phosphates, and enable a reduction in waste volume. Additionally, the liquid cleaning compositions may have incorporated in their formulations materials which could not stand drying operations without deterioration, which materials are often desirably employed in the manufacture of particular cleaning products.

The unit packaging of cleaning compositions in sachets has already been proposed in the literature, but in practice, bulk packaging of both powdered and liquid cleaning compositions in cartons, drums, bottles and the like is generally employed. However, wastage or underdosage tends to occur when the consumer is left to judge the correct amount of a product to use. Unit packaging alleviates these problems and also avoids skin contact with the cleaning composition, so that more highly alkaline and acid compositions can be used.

Sachets for unit packaging of detergent powders are disclosed in U.S. Pat. No. 4,188,304, which discloses sachets of water-insoluble, water-permeable material, which are clearly unsuitable for the packaging of liquids, and sachets designed to open in use. The latter type of sachet requires seals that are sensitive to the wash water, and they would accordingly be unsuitable, in general, for the packaging of liquids.

U.S. Pat. No. 3,277,009 discloses packets made of water-soluble film and their use for the packaging of, inter alia, solid detergent compositions and non-aqueous liquids such as petrol and carbon tetrachloride. Such packets were clearly considered unsuitable for packaging liquids having an appreciable water content since such liquids would have been expected to attack the packet walls.

Some have proposed to solve this problem by providing the cleaning composition in the form of a paste or gel which will not dissolve the film. However, liquid cleaning compositions possess advantages over pastes and gels, including faster delivery and dispersability of the cleaning ingredients.

Others have proposed coating the internal walls of the packet with water-resistant materials, such as a waxy or oleaginous material (see, e.g., U.S. Pat. Nos. 3,186,869 and 3,322,674) or a layer of plastic (see, e.g., U.S. Pat. No. 4,416,791). Unfortunately, such packets are more difficult and expensive to produce than simple, uncoated packets.

Still others have proposed multilayered packets comprising a combination of water-soluble and water-insoluble layers. For example, U.S. Pat. No. 3,790,067 discloses a disposable container having an inner layer of water-insoluble polymeric film material and an outer layer of water-soluble polymeric material. The outer layer is relatively strong, and the inner layer is sufficiently thin to be shredded under normal atmospheric forces, or the weight of material in the container, once the outer layer has dissolved away. Again, such packages are more difficult and expensive to produce than simple, uncoated packages.

U.S. Pat. No. 4,973,416 discloses an aqueous liquid laundry detergent comprising from about 10% to about 24% by weight of water and a substantially organic neutralization system which is contained in a package, preferably a pouch or packet containing a unit dose of said liquid laundry detergent, said package comprising a water soluble film-forming material. Compatibility of the liquid laundry detergent with the water-soluble film is said to be achieved by the use of a critical water level in the liquid laundry detergent in conjunction with a substantially all organic neutralization system.

The patent also teaches the use of a solvent system which is comprised of an alkanol, for example, ethanol and/or a polyol, for example, propylene glycol, which operates in conjunction with the water in the liquid laundry detergent can be used to enhance the compatibility of the liquid laundry detergent with the water-soluble film and to ensure the isotropic nature of the liquid laundry detergent.

All references, including patent documents, cited herein are hereby incorporated by reference herein in their entireties.

SUMMARY OF THE INVENTION

The invention provides a stable water-soluble cleaning packet containing a liquid cleaning and disinfecting concentrate. The concentrate preferably comprises about 55 wt. % to about 75 wt. % of at least one quaternary ammonium compound having the general structural formula I:

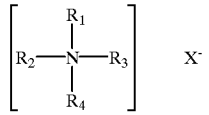

where each of $R_1$, $R_2$, $R_3$ and $R_4$ is independently a hydrophobic, aliphatic, aryl aliphatic or aliphatic aryl radical of from 6 to 26 carbon atoms, and X is an anion; about 15 wt. % to about 35 wt. % of at least one nonionic surfactant; and about 5 wt. % to about 15 wt. % of at least one polyol containing from 2 to 6 carbons and from 2 to 6 hydroxyl groups.

Preferably, $R_1$ and $R_4$ are $CH_3$, and $R_2$ and $R_3$ are the same or different $C_8$–$C_{12}$ alkyl. In certain of these embodiments, X is chloride.

Preferably, $R_1$ and $R_4$ are $CH_3$, $R_2$ is $C_{6-12}$ alkyl, $C_{8-18}$ alkylethoxy, or $C_{8-18}$ alkylphenoxyethoxy, $R_3$ is benzyl, and X is a halide or methosulfate. In certain of these embodiments, $R_2$ is $C_{6-12}$ alkyl, $R_3$ is benzyl and X is halide. In certain of these embodiments, X is chloride.

Preferably, said concentrate comprises at least two different ones of said at least one quaternary ammonium compound.

In embodiments, a first one of said at least one quaternary ammonium compound has the general structural formula I, where $R_1$ and $R_4$ are $CH_3$, and $R_2$ and $R_3$ are the same or different alkyl, and a second one of said at least one quaternary ammonium compound has the general structural formula I, where $R_1$ and $R_4$ are $CH_3$, $R_2$ is alkyl, alkylethoxy, or alkylphenoxyethoxy, $R_3$ is benzyl, and X is a halide.

In embodiments, a first one of said at least one quaternary ammonium compound has the general structural formula I, where $R_1$ and $R_4$ are $CH_3$, and $R_2$ and $R_3$ are the same or different $C_8$–$C_{12}$ alkyl, and a second one of said at least one quaternary ammonium compound has the general structural formula I, where $R_1$ and $R_4$ are $CH_3$, $R_2$ is $C_{6-12}$ alkyl, $C_{8-18}$ alkylethoxy, or $C_{8-18}$ alkylphenoxyethoxy, $R_3$ is benzyl, and X is a halide.

In embodiments, a first one of said at least one quaternary ammonium compound has the general structural formula I, where $R_1$ and $R_4$ are $CH_3$, and $R_2$ and $R_3$ are the same or different $C_8$–$C_{12}$ alkyl, and a second one of said at least one quaternary ammonium compound has the general structural formula I, where $R_1$ and $R_4$ are $CH_3$, $R_2$ is $C_{6-12}$ alkyl, $R_3$ is benzyl, and X is a halide.

Preferably, a first one of said at least one quaternary ammonium compound is dialkyldimethyl ammonium chloride and a second one of said at least one quaternary ammonium compound is alkyldimethylbenzyl ammonium chloride.

Preferably, said at least one nonionic surfactant is a alkylphenol-ethyleneoxide condensate having an alkyl group containing from 9%–12% carbon atoms and containing 9%–15% oxyethylene units.

Preferably, said at least one nonionic surfactant is a nonyl phenoxypolyethyleneoxy ethanol and said at least one polyol is hexylene glycol.

Preferably, the packet comprises about 35 wt. % alkyldimethylbenzyl ammonium chloride, about 29 wt. % dialkyldimethyl ammonium chloride, about 25 wt. % nonyl phenoxypolyethyleneoxy ethanol, about 9.5 wt. % hexylene glycol and about 2 wt. % marine fragrance.

Preferably, the concentrate comprises less than 7.5 wt. % water, and said container comprises a single-layer, water-soluble film having an internal surface directly contacting said concentrate, and having an external surface which is an outermost portion of said packet.

Preferably, said container consists essentially of said film, which consists essentially of polyvinyl alcohol.

Also provided is a method for cleaning and disinfecting a non-textile surface, said method comprising providing a packet according to claim 1, providing a volume of water, combining said packet and said volume of water to dissolve the container and dilute the concentrate within the container to form an aqueous cleaning and disinfecting composition, and applying the aqueous cleaning and disinfecting composition to a non-textile surface to clean and disinfect said surface.

DETAILED DESCRIPTION OF PREFERRED EMBODIMENTS

Packets according to the invention contain concentrates which are compatible with the water-soluble containers in which they are stored. The concentrates do not substantially degrade the containers or breach their containment therewithin, despite the presence of water in certain concentrates according to the invention.

The packets are suitable for cleaning a variety of materials, and enable relatively safe and efficient handling of concentrates by both skilled and unskilled laborers.

The container of the invention comprises a water-soluble material. For purposes of the invention, a water-soluble material is defined as a material which substantially dissolves in response to being contacted with water.

It is preferred that the water-soluble material be in the form of a film. Suitable materials for the film include polyvinyl alcohol and partially hydrolyzed polyvinyl acetate and alginates. Films of polyvinyl alcohol are most preferred. The invention encompasses the use of materials having water-solubilities ranging from partial solubility in hot water to complete solubility in cold water. For example, in the case of a packet containing a cleaning concentrate for laundering textiles, it is sufficient that water at wash temperatures will cause enough disintegration of the film to allow release of the contents from the package into the wash water.

The thickness of the film itself should be sufficient to give it the required mechanical strength. Typically, the thickness of the film will lie within the range of from 0.5 to 10 mils. High bursting strength is also desirable. The film is also advantageously of high heat-sealability, since heat-sealing represents a convenient and inexpensive method of making packages according to the invention.

A particularly preferred film for use in the invention is Monosol® (Monosol, a Division of Chris Craft International, Gary, Ind., U.S.A.) having a thickness of about 2 to about 4 mils.

The film or container is preferably uncoated to minimize production costs. Unlike certain prior art packets, the contents of the packets according to the invention are compatible with the water-soluble container, and thus, protective coatings are not necessary to provide adequate stability to the packet.

The packet of the invention is conveniently in the form of a bag or sachet. The packet may be formed from one or more sheets of a packaging film or from a tubular section of such film, but it is most conveniently formed from a single folded sheet or from two sheets, sealed together at the edge regions either by means of an adhesive or, preferably, by heat-sealing. A preferred form of the packet according to the invention is a rectangular one formed from a single folded sheet sealed on three sides, with the fourth side sealed after filling the packet with liquid cleaning composition. A rectangular-shaped packet is more easily manufactured and sealed than other configurations when using conventional packaging equipment.

The liquid cleaning composition of the invention is formulated in a manner which makes it compatible with the water-soluble film for purposes of packing, shipping, storage, and use.

It is preferred to limit the amount of water in the liquid cleaning concentrate to less than 10 wt. % of the composition. In embodiments, it is preferred to limit the amount of water to less than 7.5 wt. % or less than 5 wt. %. Contrary to the teachings of U.S. Pat. No. 4,973,416 at column 2, lines 53–61, the liquid cleaning concentrate packets according to the invention are stable despite containing cleaning concentrates having less than 10 wt. % water.

Liquid cleaning concentrates suitable for use in this invention can contain, for example, a cationic surfactant, an anionic surfactant, and/or an ethoxylated nonionic surfactant, an organic neutralization system, and a solvent system comprising water and, preferably, an organic solvent and a chelating agent suitable for substantially nonaqueous environments, most preferably dimethyl glyoxime. Optional ingredients include enzymes, enzyme stabilizing agents, soil removal agents, antiredeposition agents, foam stablizers, opacifiers, antioxidants, bactericides, dyes, fragrances and brighteners. A more detailed description of optional ingredients can be found in U.S. Pat. No. 4,285,841.

To meet the constraints of the present invention which include both phase stability of the liquid cleaning concentrate and, most importantly, the surprising compatibility of the liquid cleaning concentrate with the water-soluble container, certain liquid cleaning concentrates of the invention require an organic system.

In embodiments, the organic system contains no more than 0.10 moles of organic amine per 100 grams of cleaning concentrate, and/or no more than 1 wt. % organic amine. The organic amine is preferably selected from the group consisting of monoethanolamine, diethanolamine, triethanolamine, and mixtures thereof. Monoethanolamine is most preferred because it enhances product stability and cleaning performance and has acceptable odor characteristics.

Other organic amines such as isopropanol amine, morphaline, etc., can be used although they are normally more expensive. Other amines can be used but preferably should have no, or minimal, odor.

Inorganic neutralizers are preferably not used in the liquid cleaning concentrates suitable for use in this invention in any substantial amount because they are generally insoluble in the concentrates. Inorganic neutralizers include, for example, sodium and potassium hydroxides.

The solvent system can comprise water which, as discussed above, is preferably present in an amount less than 10% by weight of the composition. A particularly suitable solvent system comprises ethanol and a polyol in addition to water. Ethanol is preferably present at a level of about 0.5 wt. % to about 50 wt. %. Isopropanol can be used in place of ethanol. Any polyol containing 2 to 6 carbon atoms and 2 to 6 hydroxy groups can be used. These polyols include ethylene glycol, propylene glycol, hexylene glycol and glycerine. Hexylene glycol and propylene glycol are particularly preferred.

Suitable anionic surfactants include the water-soluble salts, particularly the alkali metal salts, of sulfonated surfactants such as those disclosed in U.S. Pat. Nos. 4,285,841 and 3,919,678. These include the water soluble salts of the alkylbenzene sulfonates in which the alkyl group contains from about 8 to about 15 carbon atoms in a straight or branched chain configuration. Linear straight chain alkylbenzene sulfonates in which the average number of carbon atoms in the alkyl group is from about 11 to about 13 are particularly useful.

Suitable nonionic surfactants include, but are not limited to, polyoxyethylene ethers such as those sold under the mark TRITON™ (Rohm and Haas), for example TRITON™ X-100 and TRITON™ N101 nonionic surfactants, or under the mark BRIJ™ (ICI Americas, Inc.), polyoxyethylenesorbitan derivatives such as those sold under the mark TWEEN™ (ICI Americas, Inc.), for example TWEEN™ 20 nonionic surfactants, and polyglycol ethers such as those sold under the mark TERGITOL™ (Union Carbide), for example TERGITOL™ NPX and TERGITOL™ NP-7 nonionic surfactants. Preferable nonionic surfactants include alkylphenol-ethyleneoxide condensates having an alkyl group containing from 9%–12% carbon atoms and containing 9%–15% oxyethylene units, such as TERGITOL NPX™ , STEROX DJ™, and IGEPAL CO 630™.

Cationic surfactants which exhibit germicidal activity and which may be used in the liquid 5 cleaning concentrate include certain quaternary ammonium surfactants. Exemplary useful quaternary ammonium compounds and salts thereof include quaternary ammonium germicides which may be characterized by the general structural formula I:

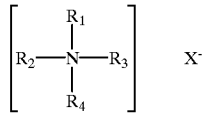

where at least one of $R_1$, $R_2$, $R_3$ and $R_4$ is a hydrophobic, aliphatic, aryl aliphatic or aliphatic aryl radical of from 6 to 26 carbon atoms, and the entire cation portion of the molecule has a molecular weight of preferably at least 165. The hydrophobic radicals may be long-chain alkyl, long-chain alkoxy aryl, long-chain alkyl aryl, halogen-substituted long-chain alkyl aryl, long-chain alkyl phenoxy alkyl, aryl alkyl, etc. The remaining radicals on the nitrogen atoms other than the hydrophobic radicals are substituents of a hydrocarbon structure usually containing a total of no more than 12 carbon atoms. The radicals $R_1$, $R_2$, $R_3$ and $R_4$ may be straight chained or may be branched, but are preferably straight chained, and may include one or more amide or ester linkages. The radical X may be any salt-forming anionic radical, and is preferably a halogen ion and more preferably chloride ion.

Exemplary quaternary ammonium salts within the above description include alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide or ester linkages such as octylphenoxyethoxyethyldimethylbenzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are useful in the practice of the present invention include those which have the following structural formula II:

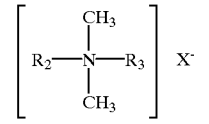

where $R_2$ and $R_3$ are the same or different $C_8$–$C_{12}$ alkyl, or $R_2$ is $C_{6-12}$ alkyl, $C_{8-18}$ alkylethoxy, $C_{8-18}$ alkylphenoxyethoxy and $R_3$ is benzyl, and X is a halide, for example chloride, bromide or iodide or is methosulfate. The alkyl groups recited in $R_2$ and $R_3$ may be straight chained or branched, but are preferably substantially linear.

According to U.S. Pat. No. 5,798,329 to Taylor et al., such quaternary germicides are usually sold as mixtures of two or more different quaternaries, such as BARDAC™ 205M, (Lonza, Inc., Fairlawn, N.J.) which is believed to be a 50% aqueous solution containing 20% by weight of an alkyl dimethyl benzylammonium chloride (50% $C_{14}$, 40% $C_{16}$ alkyl); 15% by weight of an octyl 5 decyl dimethylammonium chloride; 7.5% by weight of dioctyl dimethylammonium chloride; and 7.5% by weight of didecyl dimethylammonium chloride. A further useful quaternary germicide is CYNCAL™ 80% (Hilton Davis Chemical Co., Cincinnati, Ohio) which is believed to comprise 80% by weight of an alkyl dimethyl benzylammonium chloride (50% $C_{14}$, 40% $C_{12}$ and 10% $C_{16}$ alkyl), 10% water and 10% ethanol. Further useful quaternary germicidal agents include BTC-8358™, an 0 alkyl benzyl dimethyl ammonium chloride (80% active) and BTC-818™, a dialkyl dimethyl ammonium chloride (Stepan Chemical Co., Chicago, Ill.). Additional suitable commercially available quaternary ammonium germicides of the alkyl dimethyl benzylammonium chloride type containing the same alkyl dimethyl benzylammonium chloride mixture as that of CYNCAL™ and which are generally referred to as quaternium salts include BARQUAT™ MB-80, which is believed to be solution of 80% by weight solution of the quaternary, 10% wt. ethanol and 10% wt. water; BARQUAT™ MB-50, believed to be 50% wt. alkyl dimethyl benzylammonium compound, 40% wt. water and 10% ethanol; HYAMINE™ 1622 believed to be an aqueous solution of benzethonium chloride, and HYAMINE™ 3500, which is believed to be a 50% aqueous solution of the quaternary (Lonza Inc.).

The most preferred cationic surfactant for use in the practice of the present invention is BTC-888™ (Stepan Chemical Co.), which is believed to comprise 55 wt. % alkyldimethylbenzyl ammonium chloride and 45 wt. % dialkyldimethyl ammonium chloride.

Cleaning compositions prepared from the cleaning concentrates according to the invention can have a broad range of pH values, for example, from about 1 to about 13. In some embodiments, the pH is 2 to 4, in other embodiments, the pH is above 8.5, and in still other embodiments, the pH is 10 to 11. The most preferred embodiment of the invention has a pH of about 7.28.

The liquid cleaning concentrate is preferably contained within a single layer film having an internal surface directly contacting said concentrate, and having an external surface which is an outermost portion of said cleaning packet.

Packets according to the invention can be used to clean a variety of materials. In embodiments, the method according to the invention comprises providing a cleaning packet comprising a liquid cleaning concentrate and a water-soluble container containing said concentrate; providing a volume of water; adding said cleaning packet to said volume of water to dissolve the water-soluble container and dilute the cleaning concentrate within the container to form an aqueous cleaning composition; and applying the aqueous cleaning composition to a material to clean said material.

Typically, the packets are formulated for a particular use; however, multipurpose cleaning packets are within the scope of the invention. Such multipurpose cleaning packets can be formulated for universal use, or for something less than universal use, such as use on non-textiles.

The invention will be illustrated in more detail with reference to the following Examples, but it should be understood that the present invention is not deemed to be limited thereto. Unless otherwise stated, all parts, percentages, and ratios are by weight.

EXAMPLE 1

Neutral Floor Cleaner

A neutral floor cleaner is prepared by mixing the following ingredients:

| | |
|---|---|
| Dimethyl monoethyl ether | 75.49% |
| Sodium lauryl sulfate | 8.00% |
| Dimethyl glyoxime | 0.50% |
| Monoethanolamine (99%) | 0.40% |
| Nonyl phenoxypolyethyleneoxy ethanols (NPX) (9.5 moles type) | 13.61% |
| Water | 2.00% |

The dimethyl monoethyl ether (hereinafter DM) is agitated prior to addition of the sodium lauryl sulfate (SLS PWD Poly Step B3, hereinafter SLS), with agitation continued until the SLS and dimethyl glyoxime are thoroughly dissolved. After combining the foregoing ingredients, 2.25 fluid ounces of fragrance (Sundance) and 0.0544 grams of uranine yellow dye are added per gallon of cleaning composition.

EXAMPLE 2

Heavy-Duty Floor Cleaner

A heavy-duty floor cleaner is prepared by mixing the following ingredients:

| | |
|---|---|
| 2-Butoxyethanol | 60.03% |
| Sodium lauryl sulfate | 1.00% |
| Dimethyl glyoxime | 0.50% |
| Monoethanolamine (99%) | 15.00% |
| NPX (9.5 moles type) | 5.00% |
| Hexylene glycol | 18.47% |

The 2-butoxyethanol is agitated prior to addition of the sodium lauryl sulfate. After combining the foregoing ingredients, 0.80 fluid ounces of fragrance (Sassafras Fragrance 42180) and 0.8847 grams of Orco Milling Violet are added per gallon of cleaning concentrate.

EXAMPLE 3

Neutralizer/Conditioner

A neutralizer/conditioner is prepared by mixing the following ingredients:

| | |
|---|---|
| 25% citric acid/hexyleneglycol solution | 80.00% |
| Hexylene glycol | 10.75% |
| NPX (9.5 moles type) | 0.75% |
| Isopropyl alcohol-99% | 8.50% |

The hexylene glycol and NPX are added to the citric acid solution and mixed for 10 minutes. The composition will thin after addition of isopropyl alcohol (hereinafter IPA).

EXAMPLE 4

Laundry Detergent

A laundry detergent is prepared by mixing the following ingredients:

| | |
|---|---|
| DM | 73.87% |
| SLS | 6.00% |

-continued

| | |
|---|---|
| Dimethyl glyoxime | 1.00% |
| IPA-99% | 0.50% |
| Trazinyl stilbene (Tinopal UNPA-GX) | 0.50% |
| Monoethanolamine | 1.52% |
| Linear alcohol ethoxylate (Surfonic LF-17) | 13.61% |
| d-limonene | 3.00% |

The DM, SLS and dimethyl glyoxime are combined first and allowed to mix for 10 minutes. The IPA and Tinopal are premixed to form a thick paste, and then added to the mixture and allowed to mix for 10 minutes before adding the monoethanolamine.

EXAMPLE 5

Dish Detergent and Pot/Pan Cleaner

A dish detergent and pot/pan cleaner is prepared by mixing the following ingredients:

| | |
|---|---|
| Hexylene glycol | 10.00% |
| NPX (9.5 moles type) | 40.00% |
| Amine oxide (FMB A0-8) | 6.50% |
| S-10 coconut amide (2:1 cocoa diethanolamide condensate) (ESI) | 43.50% |

After combining the foregoing ingredients, 7.50 fluid ounces of fragrance (Lemon Joy) are added per gallon of cleaning concentrate.

EXAMPLE 6

Flatware Presoak

A flatware presoak is prepared by mixing the following ingredients:

| | |
|---|---|
| NPX (9.5 moles type) | 42.00% |
| Amine oxide (FMB A0-8) | 5.00% |
| S-10 coconut amide | 36.00% |
| DM | 17.00% |

After combining the foregoing ingredients, 2.70 fluid ounces of fragrance (almond) and 0.40 grams of alizarine green GN are added per gallon of cleaning concentrate.

EXAMPLE 7

Delimer

A delimer is prepared by mixing the following ingredients:

| | |
|---|---|
| 25% Citric acid/hexylene glycol solution | 80.00% |
| Hexylene glycol | 10.75% |
| NPX (9.5 moles type) | 0.75% |
| Isopropyl alcohol-99% | 8.50% |

The hexylene glycol and NPX are added to the citric acid solution and mixed for 10 minutes. The composition will thin after addition of isopropyl alcohol. Some of the isopropyl alcohol should be retained as a solvent for adding dye (Alizarine Green GN, 0.3840 grams/gal of composition) to the composition.

EXAMPLE 8

Glass and Hard Surface Cleaner

A glass and hard surface cleaner is prepared by mixing the following ingredients:

| | |
|---|---|
| IPA-99% | 55.00% |
| 2-butoxyethanol | 37.00% |
| Monoethanolamine-99% | 3.00% |
| NPX (30 moles type) | 5.00% |

After combining the foregoing ingredients, 7.50 fluid ounces of fragrance (Windex 46952) and 1.62 grams of cyan dye (LX-9544) are added per gallon of cleaning concentrate.

EXAMPLE 9

Citrus All-Purpose Cleaner

A citrus all-purpose cleaner is prepared by mixing the following ingredients:

| | |
|---|---|
| 2-butoxyethanol | 13.50% |
| Hexylene glycol | 15.00% |
| d-limonene | 15.00% |
| SLS | 4.00% |
| Dimethyl glyoxime | 0.50% |
| Monoethanolamine-99% | 2.00% |
| Alkanolamide (NINOL 201) | 2.50% |
| NPX (9.5 moles type) | 47.50% |

The first four ingredients in the foregoing list are mixed together for 10 minutes before adding dimethyl glyoxime. After mixing for a further 10 minutes, the balance of the ingredients are added. After combining the foregoing ingredients, 1.37 fluid ounces of fragrance (Lemon Joy) and 1.20 grams of wool orange are added per gallon of cleaning concentrate.

EXAMPLE 10

Odor Suppressant

An odor suppressant is prepared by mixing the following ingredients:

| | |
|---|---|
| IPA-99% | 25.00% |
| Hexamethylene tetraamine | 1.00% |
| Propylene glycol (USP) | 18.30% |
| NPX (9.5 moles type) | 13.50% |
| Apple concentrate | 21.10% |
| Glassworks fragrance | 21.10% |

The hexamethylene tetraamine is mixed into the IPA. After combining the balance of the ingredients, 0.1353 grams of Alizarine Green GN and 0.0410 grams of Metanil Yellow Dye are added per gallon of cleaning concentrate.

EXAMPLE 11

Non-Acid Bowl and Bathroom Cleaner

A non-acid bowl and bathroom cleaner is prepared by mixing the following ingredients:

| | |
|---|---|
| 2-butoxyethanol | 15.40% |
| Hexylene glycol | 15.00% |
| d-limonene | 15.00% |
| SLS | 2.00% |

-continued

| | |
|---|---|
| Dimethyl glyoxime | 0.50% |
| Monoethanolamine-99% | 2.00% |
| NINOL 201 | 2.50% |
| NPX (9.5 moles type) | 47.60% |

After combining the foregoing ingredients, 1.37 fluid ounces of fragrance (Lemon Joy) and 0.80 grams of Red Oil Dye No. 2144 are added per gallon of cleaning concentrate.

EXAMPLE 12

Acidic Bowl and Bathroom Cleaner

An acidic bowl and bathroom cleaner is prepared by mixing the following ingredients:

| | |
|---|---|
| 25% citric acid/hexylene glycol solution | 80.00% |
| Hexylene glycol | 9.00% |
| NPX (9.5 moles type) | 2.50% |
| Isopropyl alcohol-99% | 8.50% |

The hexylene glycol and NPX are added to the citric acid solution and mixed for 10 minutes. The composition will thin after addition of isopropyl alcohol. Some of the isopropyl alcohol should be retained as a solvent for adding dye (Rhodamine B Extra, 0.1970 grams/gal of composition) to the composition. Baby powder fragrance is also added in an amount of 8.00 fluid ounces per gallon of composition.

EXAMPLE 13

Ball Wash

A ball wash is prepared by mixing the following ingredients:

| | |
|---|---|
| Hexylene glycol | 98.95% |
| Surfonic LF-17 | 1.00% |
| N-alkyl dimethylbenzyl ammonium (BARDAC ™ 208M) | 0.05% |

After combining the foregoing ingredients, 0.50 fluid ounces of lemon fragrance are added per gallon of cleaning concentrate.

EXAMPLE 14

Cleaning Concentrate Packets

The compositions of Examples 1–13 are packaged in water-soluble films as follows. Two polyvinyl alcohol films (M-8630, Monosol) measuring approximately 1 to 6 inches wide by 1 to 6 inches long (with the size selected based on the desired volume of the resulting packet) are heat sealed to each other along both longitudinal edges and along a line spaced about 0.2 inches from the bottom edge. As summarized in the following table, each polyvinyl alcohol packet is then filled with a unit dose (UD, in grams) of one of the example cleaning concentrates (EX) through the opening in the top portion of the pouch (see the following Table). Thereafter, the top portion is also heat sealed along a line spaced about 0.2 inches from the top edge.

| EX | 1 | 2 | 3 | 4 | 5 | 6 | 7 | 8 | 9 | 10 | 11 | 12 | 13 |
|---|---|---|---|---|---|---|---|---|---|---|---|---|---|
| UD | 30 | 45 | 45 | 45 | 30 | 20 | 12 | 12 | 12 | 12 | 12 | 12 | 12 |

Each packet is added to an amount of water appropriate for the unit dosage of cleaning concentrate contained therein. The packets release their respective cleaning concentrates upon addition to water.

EXAMPLE 15

Germicidal Detergent Containing Packet

A germicidal detergent concentrate is prepared by mixing the following ingredients:

| Ingredient | Weight % |
|---|---|
| BTC-888 ™ | 63.5 |
| NPX | 25 |
| Hexylene glycol | 9.5 |
| Marine fragrance | 2.0 |

The foregoing ingredients are mixed to provide a homogeneous mixture. Erio Blue GRL dye is then added in an amount of 22.75 grams per gallon of the mixture to provide the germicidal detergent concentrate having a pH of about 7.3, a weight per gallon of about 7.8 and a specific gravity of about 0.939.

The germicidal detergent concentrate is packaged in a water-soluble film to provide a packet in accordance with the procedure described in Example 14. The packet is added to an amount of water appropriate for the unit dosage of cleaning concentrate contained therein. The packet releases the germicidal detergent concentrate upon addition to water to provide a germicidal detergent solution ready for application to a surface to be cleaned and disinfected.

While the invention has been described in detail and with reference to specific examples thereof, it will be apparent to one skilled in the art that various changes and modifications can be made therein without departing from the spirit and scope thereof.

What is claimed is:

1. A cleaning packet comprising a water-soluble container and a germicidal detergent concentrate within said container, wherein said container comprises a water-soluble film and said concentrate is a liquid compatible with said container and comprises:

about 55 wt. % to about 75 wt. % of at least one quaternary ammonium compound having the general structural formula I:

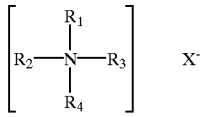

where each of $R_1$, $R_2$, $R_3$ and $R_4$ is independently a hydrophobic, aliphatic, aryl aliphatic or aliphatic aryl radical of from 6 to 26 carbon atoms, and X is an anion;

about 15 wt. % to about 35 wt. % of at least one nonionic surfactant;

about 5 wt. % to about 15 wt. % of at least one polyol containing from 2 to 6 carbons and from 2 to 6 hydroxyl groups; and less than 10 wt. % water.

2. The packet of claim 1, wherein $R_1$ and $R_4$ are $CH_3$, and $R_2$ and $R_3$ are the same or different $C_8$–$C_{12}$ alkyl.

3. The packet of claim 2, wherein X is chloride.

4. The packet of claim 1, wherein $R_1$ and $R_4$ are $CH_3$, $R_2$ is $C_{6-12}$ alkyl, $C_{8-18}$ alkylethoxy, or $C_{8-18}$ alkylphenoxyethoxy, $R_3$ is benzyl, and X is a halide or methosulfate.

5. The packet of claim 4, wherein $R_2$ is $C_{6-12}$ alkyl, $R_3$ is benzyl and X is halide.

6. The packet of claim 5, wherein X is chloride.

7. The packet of claim 1, wherein said concentrate comprises at least two different compounds of said at least one quaternary ammonium compound.

8. The packet of claim 7, wherein a first one of said at least one quaternary ammonium compound has the general structural formula I, where $R_1$ and $R_4$ are $CH_3$, and $R_2$ and $R_3$ are the same or different alkyl, and a second one of said at least one quaternary ammonium compound has the general structural formula I, where $R_1$ and $R_4$ are $CH_3$, $R_2$ is alkyl, alkylethoxy, or alkylphenoxyethoxy, $R_3$ is benzyl, and X is a halide.

9. The packet of claim 7, wherein a first one of said at least one quaternary ammonium compound has the general structural formula I, where $R_1$ and $R_4$ are $CH_3$, and $R_2$ and $R_3$ are the same or different $C_8$–$C_{12}$ alkyl, and a second one of said at least one quaternary ammonium compound has the general structural formula I, where $R_1$ and $R_4$ are $CH_3$, $R_2$ is $C_{6-12}$ alkyl, $C_{8-18}$ alkylethoxy, or $C_{8-18}$ alkylphenoxyethoxy, $R_3$ is benzyl, and X is a halide.

10. The packet of claim 7, wherein a first one of said at least one quaternary ammonium compound has the general structural formula I, where $R_1$ and $R_4$ are $CH_3$, and $R_2$ and $R_3$ are the same or different $C_8$–$C_{12}$ alkyl, and a second one of said at least one quaternary ammonium compound has the general structural formula I, where $R_1$ and $R_4$ are $CH_3$, $R_2$ is $C_{6-12}$ alkyl, $R_3$ is benzyl, and X is a halide.

11. The packet of claim 7, wherein a first one of said at least one quaternary ammonium compound is dialkyldimethyl ammonium chloride and a second one of said at least one quaternary ammonium compound is alkyldimethylbenzyl ammonium chloride.

12. The packet of claim 11, wherein said at least one nonionic surfactant is a alkylphenol-ethyleneoxide condensate having an alkyl group containing from 9%–12% carbon atoms and containing 9%–15% oxyethylene units.

13. The packet of claim 11, wherein said at least one nonionic surfactant is a nonyl phenoxypolyethyleneoxy ethanol.

14. The packet of claim 11, wherein said at least one polyol is hexylene glycol.

15. The packet of claim 12, wherein said at least one polyol is hexylene glycol.

16. The packet of claim 13, wherein said at least one polyol is hexylene glycol.

17. The packet of claim 16, comprising about 35 wt. % alkyldimethylbenzyl ammonium chloride, about 29 wt. % dialkyldimethyl ammonium chloride, about 25 wt. % nonyl phenoxypolyethyleneoxy ethanol, and about 9.5 wt. % hexylene glycol.

18. The packet of claim 16, further comprising about 2 wt. % marine fragrance.

19. The packet according to claim 1, wherein said concentrate comprises less than 7.5 wt. % water, and said container comprises a single-layer, water-soluble film having an internal surface directly contacting said concentrate, and having an external surface which is an outermost portion of said packet.

20. The packet according to claim 19, wherein said container consists essentially of said film, which consists essentially of polyvinyl alcohol.

21. The packet according to claim 17, wherein said concentrate comprises less than 7.5 wt. % water, and said container comprises a single-layer, water-soluble film having an internal surface directly contacting said concentrate, and having an external surface which is an outermost portion of said packet.

22. The packet according to claim 21, wherein said container consists essentially of said film, which consists essentially of polyvinyl alcohol.

23. A method for cleaning and disinfecting a non-textile surface, said method comprising:

providing a packet according to claim 1;

providing a volume of water;

combining said packet and said volume of water to dissolve the container and dilute the concentrate within the container to form an aqueous cleaning and disinfecting composition; and applying the aqueous cleaning and disinfecting composition to a non-textile surface to clean and disinfect said surface.

* * * * *